United States Patent [19]
Jansons et al.
[11] 3,932,959
[45] Jan. 20, 1976

[54] ADJUSTABLE SHUTTER ASSEMBLY

[75] Inventors: Eric G. Jansons; Raymond D. Clark, both of Schaumburg, Ill.

[73] Assignee: DeSoto, Inc., Des Plaines, Ill.

[22] Filed: Dec. 23, 1974

[21] Appl. No.: 535,298

Related U.S. Application Data

[63] Continuation-in-part of Ser. No. 471,231, May 20, 1974, abandoned.

[52] U.S. Cl. ..... 49/75; 49/74; 52/473
[51] Int. Cl.[2] ..... E06B 7/086
[58] Field of Search ..... 49/74, 75, 64, 505; 52/473; 98/121, 110

[56] References Cited

UNITED STATES PATENTS

| | | | |
|---|---|---|---|
| 3,455,079 | 7/1969 | Frederick | 52/473 |
| 3,491,481 | 1/1970 | Wunderlick | 49/74 |
| 3,553,891 | 1/1971 | Casebolt et al. | 49/505 |
| 3,797,186 | 3/1974 | Smith | 52/473 |

*Primary Examiner*—Philip C. Kannan
*Attorney, Agent, or Firm*—Dressler, Goldsmith, Clement & Gordon, Ltd.

[57] ABSTRACT

An adjustable shutter assembly is provided in which a pair of opposed vertical frame supports carry a plurality of spaced laterally extending louvers journaled at their ends and pivotally mounted in said supports with an actuator rod shiftably coupling the louvers. Vertical adjustment is enabled using legs which are broken off to desired length, and a boot which grips the lower end of the assembly. A shutter assembly hanging strip having an adjustable shoe at its lower end is also provided so that the assembly can be hung as desired at the sides of a window, the shoe matching the length of the hanging strip to the length of the assembly. The hanging strip includes hinge mounting means at the side of the strip to accommodate lateral adjustment of the shutter assembly.

9 Claims, 14 Drawing Figures

Fig. 1.
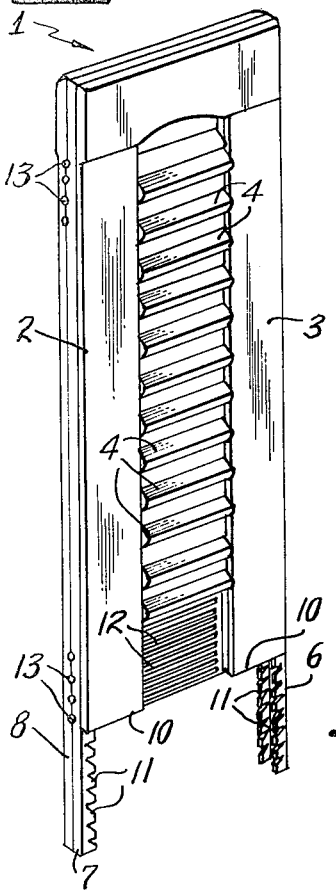
Fig. 2.
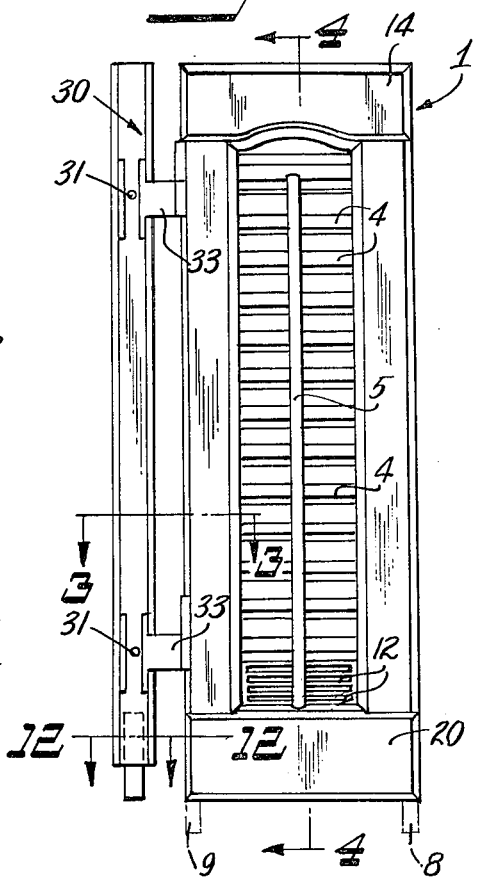
Fig. 4.
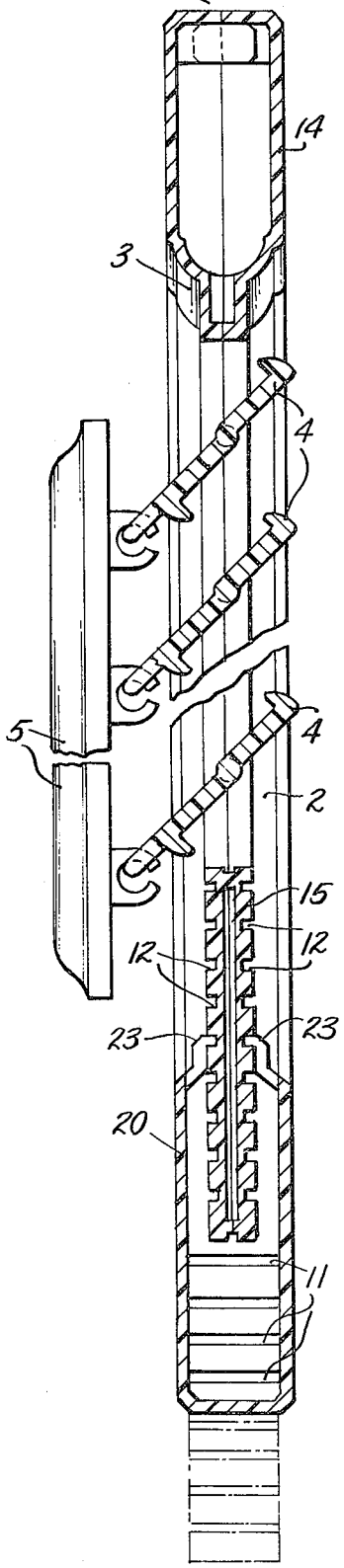
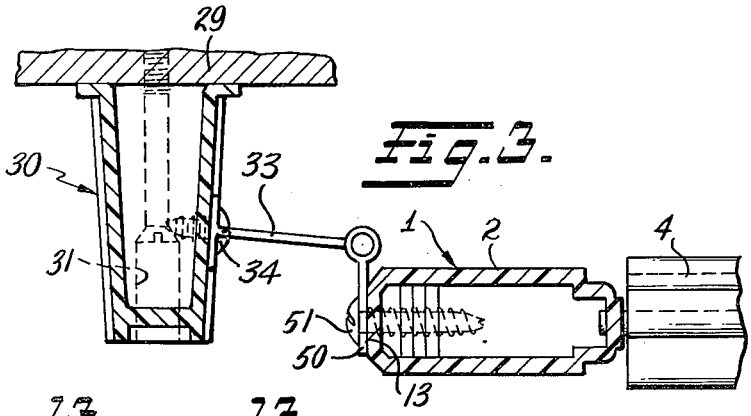
Fig. 3.
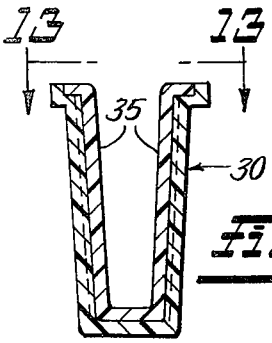
Fig. 12.

Fig. 5.
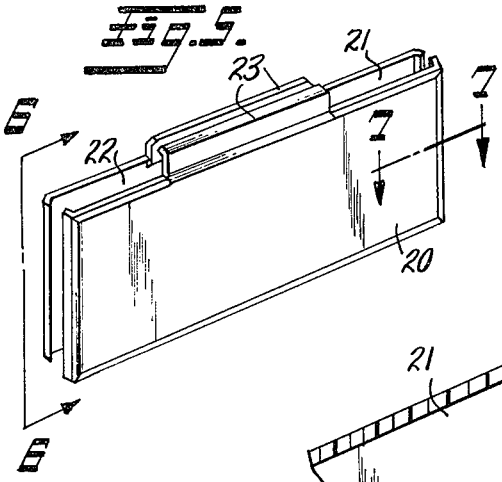
Fig. 6.
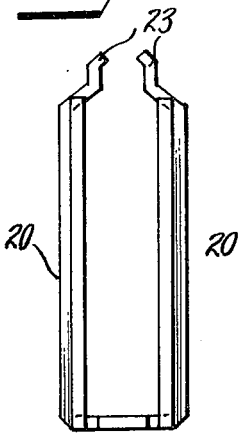
Fig. 7.
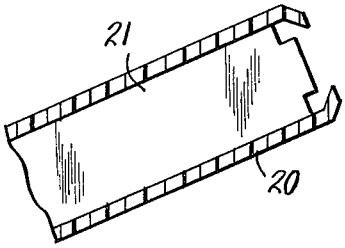
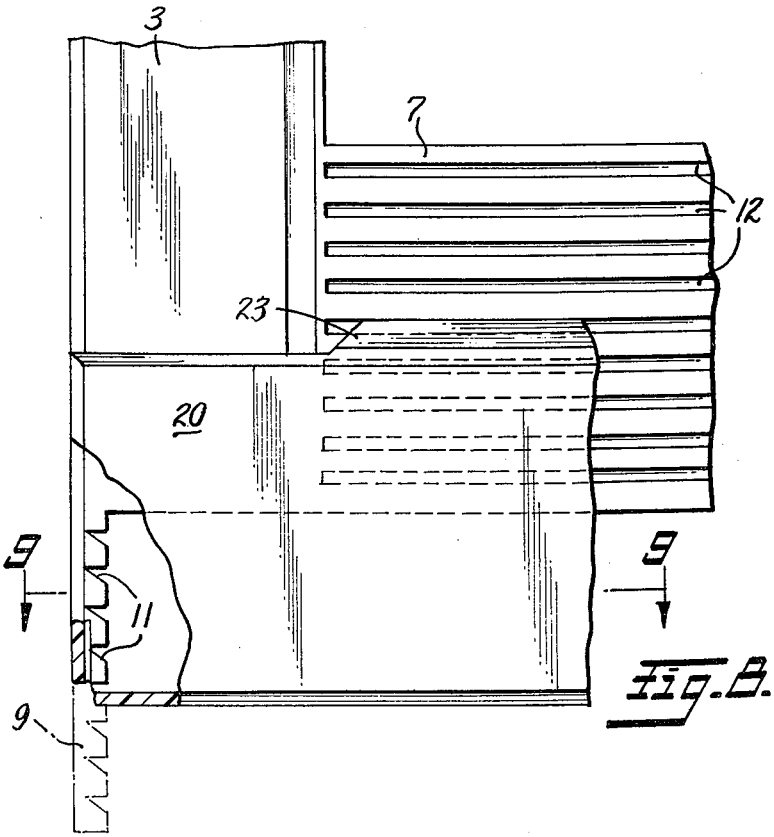
Fig. 8.
Fig. 9.
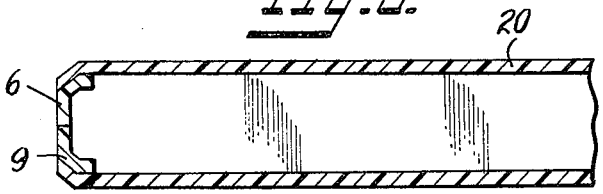

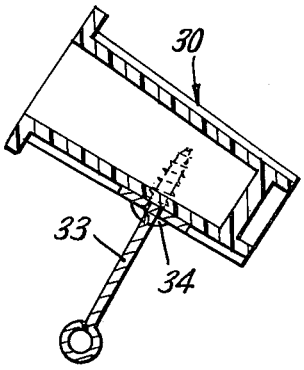
Fig. 11.
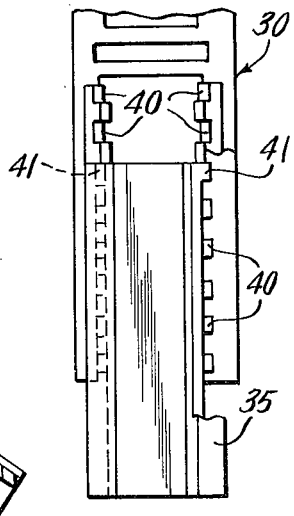
Fig. 13.
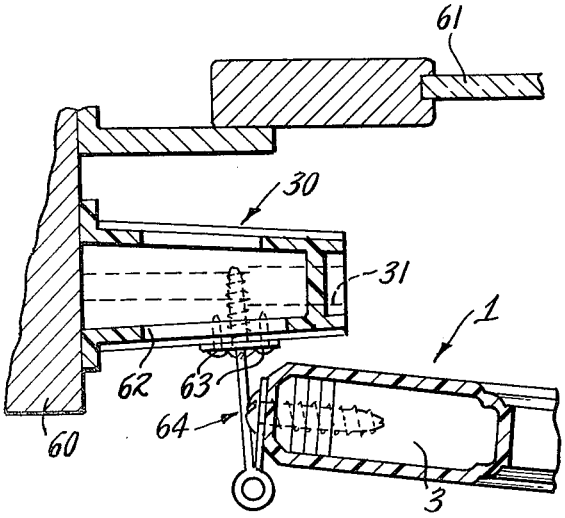
Fig. 14.
Fig. 10.
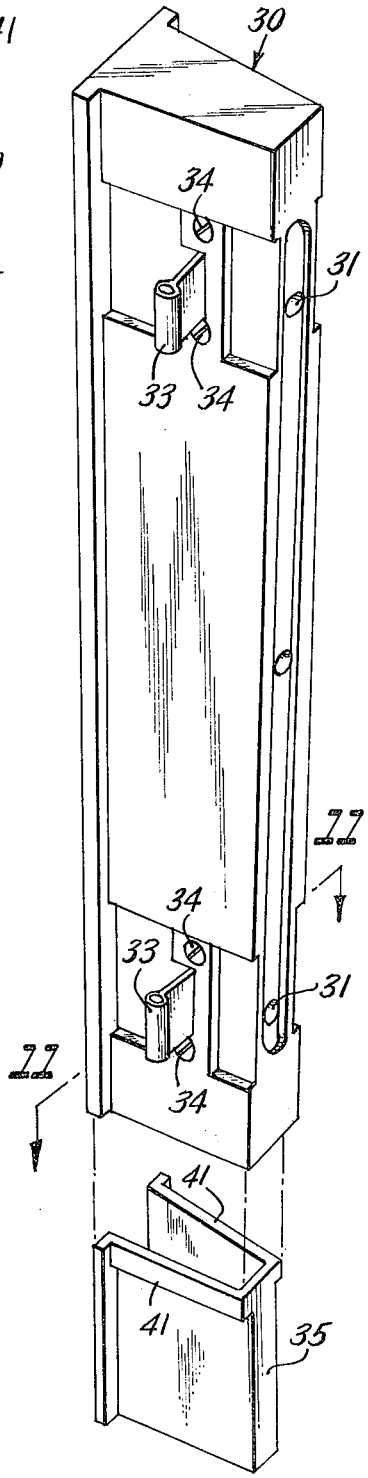

ADJUSTABLE SHUTTER ASSEMBLY

The present application is a continuation-in-part of our prior application Ser. No. 471,231, filed May 20, 1974, entitled Adjustable Shutter Assembly (File No. 8524), now abandoned.

This invention relates to an adjustable shutter assembly which may be constructed from, for example, molded plastic components, and which includes a pair of opposed vertical frame supports, attached by horizontal members at the top and bottom, and carrying a plurality of spaced laterally extending louvers which are journaled at their ends and pivotally mounted in said supports with an actuator rod for shiftably coupling the louvers. More particularly, this invention relates to an improvement in such a shutter assembly whereby the do-it-yourselfer can install such an assembly with a minimum of wasted time and with a professional result. At the present time, the installation of prior art shutters is both difficult and time-consuming, especially when so-called standard windows are not involved. Thus, the present invention provides an improved shutter assembly that is adjustable as to its length, and which can be hung as desired at the sides of a window using a minimum of tools and skill. As a result, the improved shutter assembly is capable of being installed so as to fit a great variety of window lengths and widths, and because of its versatility, is also utilizable on any vertical surface as a room divider, swinging door, and the like.

In accordance with this invention, an adjustable shutter assembly is provided in which a pair of opposed vertical frame members are secured by top and bottom members, and a plurality of spaced laterally extending louvers are journaled at their ends and pivotally mounted in the frame members with an actuator rod for shiftably coupling said louvers. Vertical adjustment means are constituted by legs which extend downwardly from the frame members, the legs being easily severable to adjust the length thereof. A boot having a generally hollow U-shaped body including internal recesses for receiving and holding the legs is used to cover the lower end of the assembly, this boot including gripper means at the upper end thereof which engage with and grasp means on a lower portion of the shutter assembly when the boot is in place covering the legs. The shutter assembly further includes a hanging strip for attaching the shutter assembly to a vertical surface, normally the sides of a window, the hanging strip being adjustable as to length to match the length of said shutter assembly. This is done using a shoe which interfits with the lower end of the hanging strip.

The invention will be more fully described by reference to the attached drawings which show a preferred construction in accordance with the invention, and in which:

FIG. 1 is a perspective view of the shutter assembly showing the back, side and top edges without the length adjustment boot in place;

FIG. 2 is a front elevation view showing the front of the shutter assembly together with its associated hanging strip, and showing the length adjustment boot and the shoe associated with the hanging strip, both in place;

FIG. 3 is an enlarged detail cross-section taken substantially along the line 3—3 of FIG. 2;

FIG. 4 is an enlarged detail vertical section taken substantially along the line 4—4 of FIG. 2;

FIG. 5 is a perspective view of the length adjustment boot;

FIG. 6 is an end view of the length adjustment boot taken substantially along the line 6—6 of FIG. 5;

FIG. 7 is a partial cross-section of the length adjustment boot taken substantially along the line 7—7 of FIG. 5;

FIG. 8 is a fragmentary elevation view of a bottom portion of the shutter assembly showing the length adjustment boot partially broken away and interengaged with the lower end of the shutter assembly to show the vertical adjustment means of this invention;

FIG. 9 is an enlarged detail sectional view of the length adjustment boot with the legs received therein, this view being taken substantially along the line 9—9 of FIG. 8;

FIG. 10 is a perspective view of the hanging strip showing attaching means, in part, for hanging the shutter assembly on the strip and showing the shoe used for vertical adjustment exploded below;

FIG. 11 is a horizontal sectional detail view taken substantially along the line 11—11 of FIG. 10;

FIG. 12 is a horizontal sectional view taken substantially along the line 12—12 of FIG. 2 showing the vertical adjustment shoe interfitted with the hanging strip;

FIG. 13 is a rear elevation detail view of the bottom of the hanging strip showing the same assembled with the shoe and taken generally along the line 13—13 of FIG. 12; and FIG. 14 is similar to FIG. 3, but showing an alternative mounting system in which a slot in the side of the hanging strip permits lateral adjustment of the shutter assembly.

Referring to the drawings, and particularly FIGS. 1 and 2, the numeral 1 generally denotes a shutter assembly comprising a pair of opposed vertical frame supports 2 and 3 attached to each other at the top and bottom by top member 14 and bottom member 15. These parts may be molded together, or joined in any convenient way by, for example, glue, heat sealing, and other ways customary in the trade. A plurality of spaced laterally extending louvers 4 are journaled at their ends and mounted in said supports 2 and 3 and an actuator rod 5 for shiftably coupling the louvers is provided.

Various types of reinforcing means may be provided throughout the frame supports and the frame supports may include various alignment means to properly line up frame supports 2 and 3 before they are attached. Pre-formed spaced mating holes 13 in the upper and lower ends of the frame support may be provided for attaching hinge means to shutter assembly 1 and the spaced mating holes 13 may lead into a series of reinforcing supports (not shown) inside frame support 2 and 3 for positively holding the hinge screws.

Referring to FIG. 1, vertical adjustment means constituted by downwardly depending legs 6, 7, 8, and 9 which extend downwardly from the bottommost portion 10 of each of said frame supports 2 and 3 are shown. These legs are shown used in pairs to form a composite leg channel-shaped in cross-section and these legs are provided with a plurality of lateral grooves 11 which are spaced apart along the length of the legs adapting the legs to be adjusted in length by simply breaking the unneeded portion.

Referring to FIGS. 2, 5 and 7, a length adjustment boot 20 comprising a generally hollow U-shaped element having at least a pair of spaced internal recesses 21 and 22 for slidably receiving the legs 6, 7, 8 and 9, legs 7 and 8, together, being received in recess 21 and legs 6 and 9, together, being received in recess 22.

It is particularly preferred that the vertical adjustment means (the legs 6, 7, 8 and 9) be an integrally formed portion or extension of each of said frame supports 2 and 3.

As is seen in FIGS. 5, 6, 7, 8 and 9, grippers 23 are disposed on an upper central portion of boot 20 for positively interengaging a lower portion of the shutter assembly 1. In a particularly preferred embodiment, the length adjustment boot 20 has grippers 23 formed thereon to frictionally engage one of several superposed ribs of a grooved portion 12 at the lower portion of the shutter assembly 1. Strip length adjustment boot 20 thus provides spaced internal recesses 21 and 22 disposed at the sides thereof for receiving and holding the legs 6, 7, 8 and 9, regardless of their length, and the grippers 23 are received in an appropriate groove between the ribs of the grooved portion 12, see particularly FIG. 4. The interfitting of the legs in the boot 20 is shown in FIGS. 8 and 9.

Referring now to FIGS. 2, 3 and 10, a shutter assembly hanging strip means 30 is provided for attaching the shutter assembly 1 to a vertical surface 29 whereby the shutter assembly can be oriented for a proper fit on hanging strip 30 in both a vertical and a horizontal direction, as will be set forth hereinafter. In a preferred embodiment, the shutter assembly hanging strip means 30 has first mounting means 31, such as screws, for mounting hanging strip 30 to the vertical surface 29. The strip 30 is provided with vertical adjustment means 40, shown in FIG. 13, comprising a series of longitudinally extending ribs and grooves disposed within a lower portion of strip 30 for adjusting the length of strip 30 before the shutter assembly is secured thereto. Shutter assembly hanging strip means 30 includes a shoe 35 having a rib 41 which interfits in a selected groove in the adjustment means 40 to regulate the length of the composite strip 30 including the shoe 35. Thus, shoe 35 is snapped into place to provide the desired length and the composite strip 30 is then rigidly attached to said vertical surface 29 by means of, for example, mounting screws 31. The shutter assembly hanging strip means 30 is also provided with means for supporting the shutter assembly 1 which may comprise a portion of a hinge 33 attached to the hanging strip 30 by mounting screws 34 so that the balance of the hinge 50 can be physically attached to shutter assembly 1 by means of screws 51 which are secured in mounting holes 13. This is shown with particular clarity in FIG. 3. The shutter assembly can thus be oriented for a proper fit on hanging strip 30 in both a vertical direction and, by means of slots described in connection with FIG. 14, in a horizontal direction as well.

Thus, it is readily apparent that an extremely versatile shutter assembly is provided. It is contemplated within the scope of this invention that each shutter assembly will be adjustable over a range of approximately 2 inches so that a purchaser of such a shutter assembly at his local store could, by knowing the measurements of his window, pick a particular shutter which approximated the size of his window and be able to use it. For example, the 20 inch length shutter will fit a window varying in size from 18–20 inch in length, and the next larger size would fit a window somewhat longer than 20 inches in length. Thus a substantially perfect fit can be assured by simply picking a size shutter assembly which is only slightly larger than the window to be fitted. Further, the hanging strip 30 packaged with the shutter assembly would vary in size by 3 inch increments. For example, the 20 inch shutter would be supplied with a hanging strip 30 of length 18 3/16 inches without the length adjusting shoe. The next size hanging strip would be 21 3/16 inch.

To illustrate the working of the present invention, a shutter having a width of 6 inches and an overall length, including the vertical adjustment means joined with the shutter assembly frame supports, of 20 inch length is selected for a window having a length to be covered of 19 inches. The strip length adjustment boot 20 is slid over the appropriately broken legs 6 and 9 and 7 and 8 until the proper overall dimension of 19 inches is achieved. The strip length adjusting boot 20 has grippers 23 which frictionally engage one of the grooves 12 located on both sides of the shutter assembly. In the present situation, the grooves 12 located approximately 1¼ inch from the bottommost portion of the shutter assembly will be engaged by the grippers 23 of boot 20. If the excess length of the legs 6, 7, 8, and 9 had not been removed earlier, then they will stick out beneath the boot and they can now be broken off by hand or cut off with a hacksaw or like cutting instrument. The strip length adjustment boot, as illustrated in FIG. 2, thus provides a finished surface for the shutter assembly.

The shutter assembly set is provided with a shutter assembly hanging strip means 30 which is easily attached to the vertical portion of the window frame to be covered by means of mounting screws. The shutter assembly hanging strip shoe is utilized to provide slight additional vertical adjustment and to provide a finished surface. The shutter assembly is then properly mounted on the hanging strip. Thus, a professionally installed result is achieved with great simplicity.

Lateral adjustment of the shutter assembly is illustrated in FIG. 14 in which the hanging strip 30 is positioned to extend into the window opening, this being shown in FIG. 14 by having the hanging strip 30 secured to the inside of the window frame 60 so as to extend partially across the window 61. The strip 30 is formed with hinge mounting slots 62 to receive securing means such as screws 63 which anchor the hinge 64. Nuts and bolts may be used in place of the screws. As will be evident, the screw 63 can be shifted laterally along the length of slot 62 to laterally position the shutter assembly 1 as desired.

Various changes coming within the spirit of my invention may suggest themselves to those skilled in the art; hence, I do not wish to be limited to the specific embodiment shown and described or uses mentioned, but intend the same to be merely exemplary, the scope of my invention being limited only by the appended claims.

I claim:

1. An adjustable shutter assembly comprising:

a. a pair of opposed vertical frame members and top and bottom members securing said vertical members;

b. a plurality of spaced laterally extending louvers journaled at their ends and pivotally mounted in said frame members;

c. an actuator rod shiftably coupling said louvers;

d. vertical adjustment means comprising legs extending downwardly from said frame members, said legs being easily severable to adjust the length thereof;

e. a boot having a generally hollow U-shaped body including internal recesses receiving and holding said legs, said boot including gripper means at the upper end thereof; and f. means on a lower portion of said shutter assembly to be grasped by said gripper means when said boot is in place upon said legs.

2. An adjustable shutter assembly as recited in claim 1 further including a hanging strip connected to said shutter for attaching said shutter assembly to a vertical surface, said hanging strip being adjustable as to length to match the length of said shutter assembly.

3. An adjustable shutter assembly as recited in claim 1 in which said hanging strip includes hinge mounting means at the side of the strip.

4. An adjustable shutter assembly as recited in claim 3 in which said mounting means is constituted by a lateral slot.

5. An adjustable shutter assembly as recited in claim 1 in which said gripper means are centrally positioned and coact with grooves on the lower central portion of said shutter assembly.

6. An adjustable shutter assembly as recited in claim 1 in which said legs are integrally formed with said frame members.

7. An adjustable shutter assembly as recited in claim 1 in which said legs are formed with vertically spaced lateral grooves to facilitate breaking to desired length.

8. An adjustable shutter assembly as recited in claim 2 in which said hanging strip is formed with vertically spaced laterally extending inner grooves at its lower end and a depending shoe with a flange at its upper end is fitted within said hanging strip, the flange interengaging with one of said grooves.

9. An adjustable shutter assembly as recited in claim 1 in which the internal recesses in said boot are disposed at the outer ends of said U-shaped body and form bearing surfaces for holding said legs within said boot.

* * * * *